US011506029B2

(12) United States Patent
Wuensche et al.

(10) Patent No.: US 11,506,029 B2
(45) Date of Patent: Nov. 22, 2022

(54) LIMITED PENETRATION SHAPED CHARGE

(71) Applicant: Halliburton Energy Services, Inc., Houston, TX (US)

(72) Inventors: Thomas J. Wuensche, Granbury, TX (US); Kevin Harive, Houston, TX (US); Thomas E. Burky, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 16/329,719

(22) PCT Filed: Dec. 12, 2017

(86) PCT No.: PCT/US2017/065848
§ 371 (c)(1),
(2) Date: Feb. 28, 2019

(87) PCT Pub. No.: WO2019/117874
PCT Pub. Date: Jun. 20, 2019

(65) Prior Publication Data

US 2021/0381348 A1 Dec. 9, 2021

(51) Int. Cl.
*E21B 43/117* (2006.01)
*E21B 43/119* (2006.01)
*F42B 1/036* (2006.01)

(52) U.S. Cl.
CPC ..... *E21B 43/117* (2013.01); *E21B 43/119* (2013.01); *F42B 1/036* (2013.01)

(58) Field of Classification Search
CPC ..... E21B 43/11; E21B 43/117; E21B 43/116; E21B 43/119; F42B 1/036
See application file for complete search history.

(56) References Cited

U.S. PATENT DOCUMENTS

| | | | |
|---|---|---|---|
| 5,479,860 | A | 1/1996 | Ellis |
| 5,753,850 | A | 5/1998 | Chawla et al. |
| 6,308,634 | B1 | 10/2001 | Fong |
| 7,165,614 | B1 | 1/2007 | Bond |
| 7,299,735 | B2 | 11/2007 | Alford |

(Continued)

OTHER PUBLICATIONS

Korean Intellectual Property Office, International Search Report and Written Opinion, PCT/US2017/065848, dated Sep. 6, 2018, 13 pages, Korea.

(Continued)

*Primary Examiner* — Yong-Suk (Philip) Ro
(74) *Attorney, Agent, or Firm* — John Wustenberg; C. Tumey Law Group PLLC

(57) ABSTRACT

A shaped charge for use in a well perforating tool includes a jet blocker disposed in an apex of a parabolic or cone-shaped liner. The jet blocker limits the velocity and/or length of a jet that forms upon discharging an explosive in the shaped charge. The jet blocker may include an inert cast-cure type of material such as an epoxy or a flowable plastic that can be readily inserted into an existing shaped charge to fill an external concavity in the liner to any desired height. The height and material selected for the jet blocker determines the degree to which the penetration achieved by the shaped charge is limited, and thus, determines which targeted annulus in the wellbore may be penetrated in operation.

20 Claims, 6 Drawing Sheets

(56) References Cited

U.S. PATENT DOCUMENTS

| | | | | |
|---|---|---|---|---|
| 2001/0052303 | A1 | 12/2001 | Mayseless et al. | |
| 2005/0115448 | A1 | 6/2005 | Pratt et al. | |
| 2016/0245053 | A1 | 8/2016 | Yang et al. | |
| 2020/0270973 | A1 * | 8/2020 | Baumann | E21B 43/116 |

OTHER PUBLICATIONS

Office Action issued for Brazilian Patent Application No. 112020005309-0, dated Jan. 12, 2022, 4 pages.
Search Report issued for French Patent Application No. 1860413, dated Apr. 1, 2020, 9 pages.

* cited by examiner

LIMITED PENETRATION SHAPED CHARGE

CROSS-REFERENCE TO RELATED APPLICATIONS

This application is a U.S. national stage patent application of International Patent Application No. PCT/US2017/065848, filed on Dec. 12, 2017, the benefit of which is claimed and the disclosure of which is incorporated herein by reference in its entirety.

BACKGROUND

The present disclosure relates generally to wellbore completions, e.g., for wellbores employed in oil and gas exploration and production. More particularly, embodiments of the disclosure relate to reducing a force of an explosive charge to provide a limited penetration into a geologic formation, or penetration through a limited number of the various layers (casing, liners, etc.) disposed in the wellbore.

Hydrocarbons may be produced through wellbores drilled from a surface location through a variety of producing and non-producing geologic formations. A wellbore may be substantially vertical, or may include horizontal and other deviated portions. A variety of servicing operations may be performed in a wellbore once drilling has been completed. For example, a casing string can be set and cemented in the wellbore, e.g., to stabilize the geologic formation surrounding the wellbore. A liner may hung to extend at least partially within the casing string, and the casing string and/or liner may be perforated by firing a perforation gun or perforation tool.

Perforation tools may include explosive charges, which may be deployed at an appropriate depth in the wellbore and detonated to perforate one or more of the various casing and liner layers, and/or the geologic formation surrounding the wellbore. Creating a large perforation in the casing geologic formation is often desirable to increase the permeability of hydrocarbons into the wellbore. In some instances, a limited or controlled explosive charge may be desirable to generate perforations that extend through some, but not all, of the casing layers in the wellbore, e.g., to promote fluid flow between intermediate annular regions in the wellbore.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes a shaped charge for use in a well perforating tool, for example. The shaped charge includes a jet blocker disposed in an apex of a parabolic or cone-shaped liner, which limits the velocity or length of a jet that forms upon discharging an explosive in the shaped charge. The jet blocker may include an inert cast-cure type of material such as an epoxy or a flowable plastic that can be readily inserted into an existing shaped charge to fill the liner to any desired height. The height and material selected for the jet blocker determines the degree to which the penetration achieved by the shaped charge is limited, and thus, determines which annulus in the wellbore may be penetrated in operation.

Figure 1:
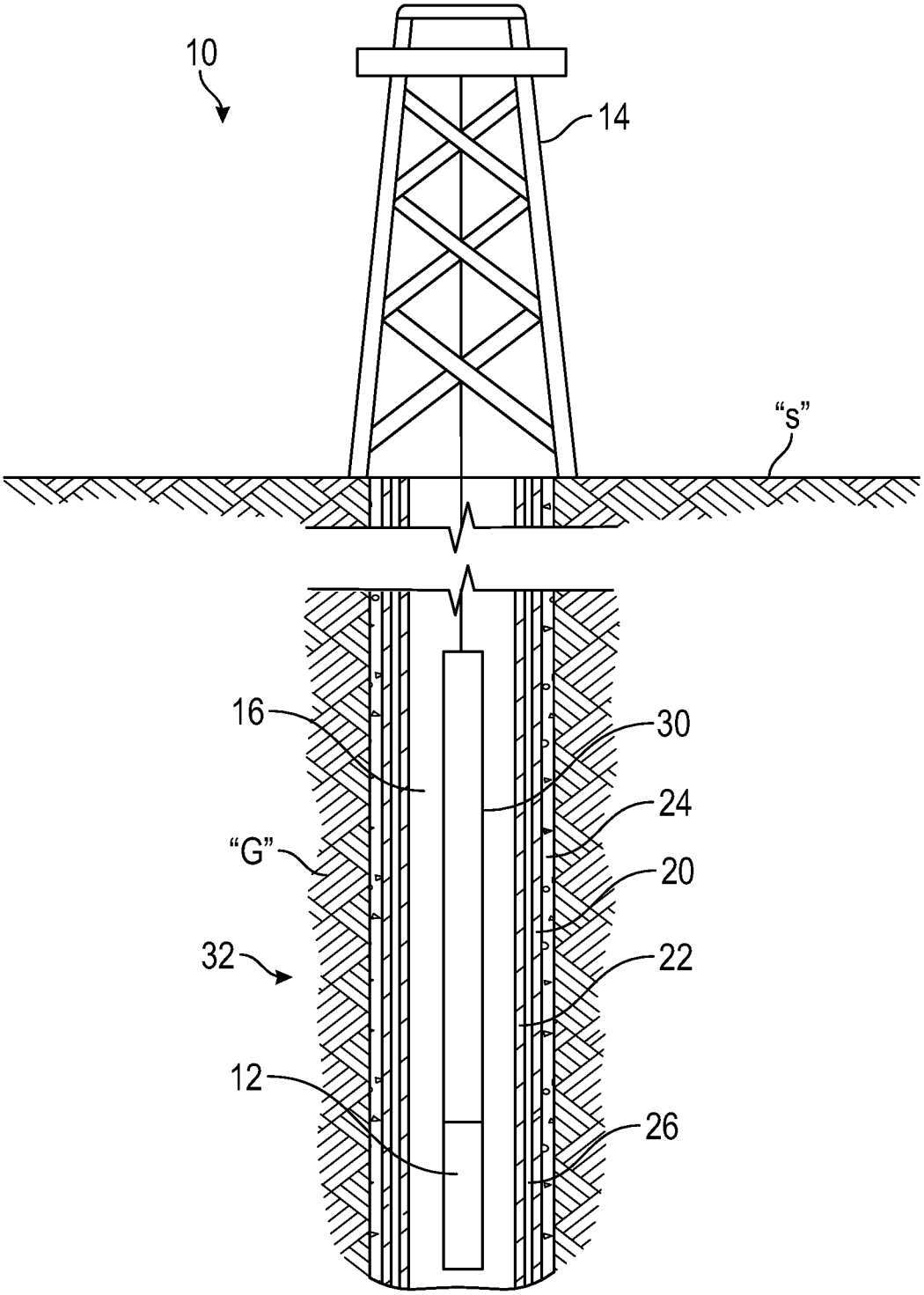
FIG. 1 is a partial cross-sectional side view of a wellbore system including a perorating tool according to the present disclosure.

FIG. 1 is a partial cross-sectional side view of a wellbore servicing system 10 that includes a perforating tool 12 in accordance with example embodiments of the present disclosure. The wellbore servicing system 10 includes a servicing rig 14 at a surface location "S." The servicing rig 14 extends over and around a wellbore 16 that penetrates a subterranean geologic formation "G." The wellbore 16 may be employed for the purpose of recovering hydrocarbons, storing hydrocarbons, disposing of carbon dioxide, or the like. The wellbore 16 may be drilled into the geologic formation "G" using any suitable drilling technique. While illustrated as extending vertically from the surface location "S" in FIG. 1, in other examples, the wellbore 16 may be deviated, horizontal, or curved over at least some portions of the wellbore 16. The wellbore 16 extends from a terrestrial surface location "S," and in other embodiments, a wellbore may extend from a subsea location in accordance with other aspects of the present disclosure.

The wellbore 16, as illustrated in FIG. 1, is cased with an outer casing 20 and an inner casing 22. The outer casing 20 is secured in place with cement 24, which fills the annular region between the outer casing and the geologic formation "G." The inner casing 22 extends within the outer casing 20 such that a target annulus 26 is defined between the inner and outer casings 22, 20. In some example embodiments, the perforating tool 12 may be employed to access the target annulus 26 without penetrating the outer casing 20. In other embodiments, a wellbore may be alternately configured, e.g., the wellbore may be open hole, contain tubing, etc., and other regions in the wellbore may be targeted by the perforating tool 12.

The perforating tool 12 may be run-in, withdrawn, rotated and otherwise moved in wellbore 16 by a conveyance 30 extending to the surface location "S." The conveyance 30 may include a wireline, slickline, coiled tubing and/or a drill sting as recognized by those skilled in the art. The conveyance 30, perforating tool 12 and other devices may be coupled to one another to form a workstring 32.

Figure 2:
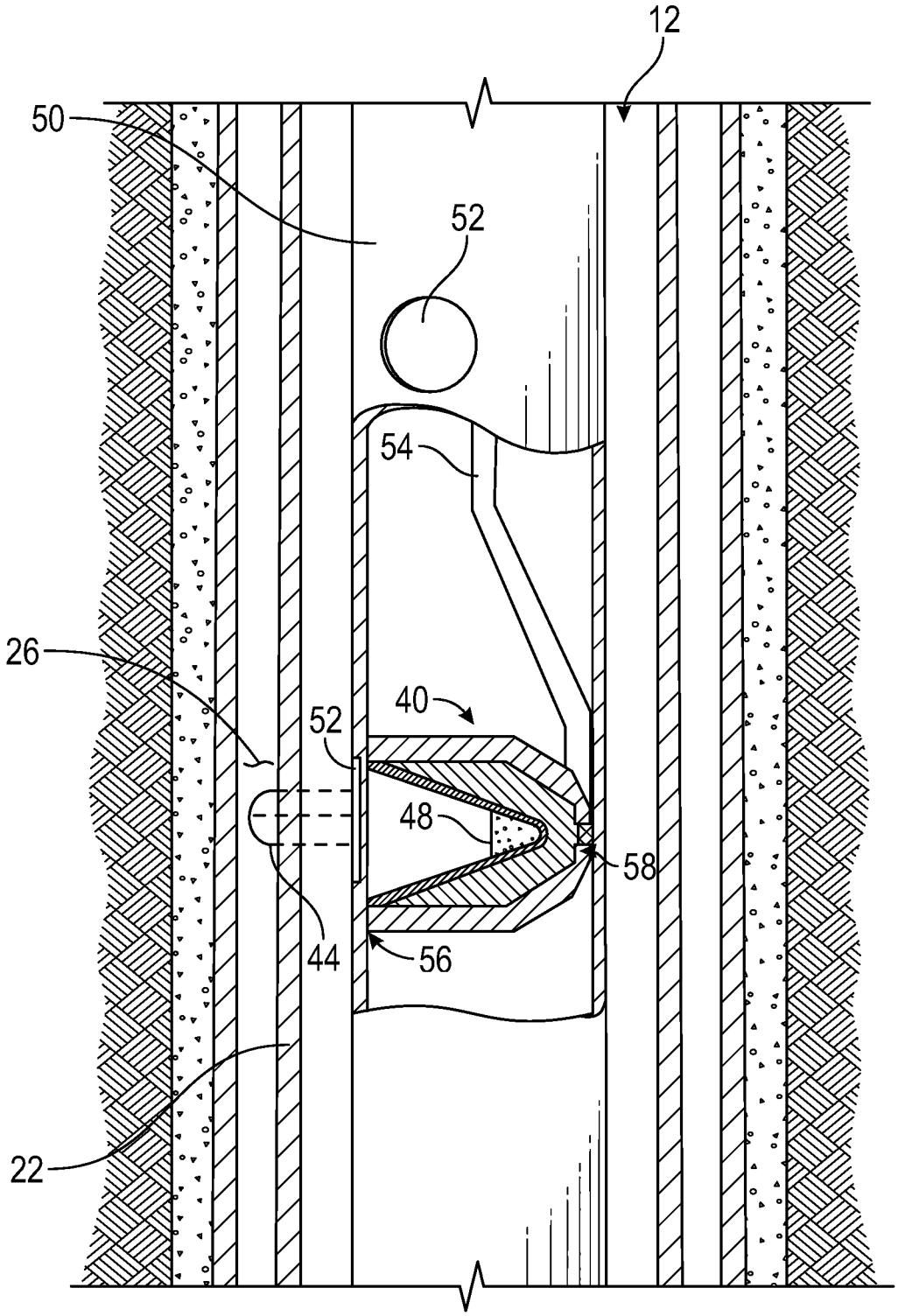
FIG. 2 is an enlarged, partial cross-sectional view of the perforating tool of FIG. 1 illustrating a shaped charge therein for forming a limited penetration perforation through some, but not all of the casing layers in the wellbore.

FIG. 2 is an enlarged, partial cross-sectional view of the perforating tool 12 including a shaped charge 40 therein for forming a limited penetration perforation. Although the shaped charge 40 is illustrated as a deep penetrating charge, it should be appreciated that aspects of the present disclosure are transferrable to other types of shaped charges including big hole or good hole shaped charges, which rely on liner collapse to produce a penetrating jet (see, e.g., FIGS. 5E and 6E).

An explosion of the shaped charge 40 results in a passageway 44 that extends through the inner casing 22 to the target annulus 26, but not through the outer casing 20. In other embodiments, a passageway could be formed that penetrates all of the casing layers and cement layers in a wellbore and extends into the surrounding geologic formation "G." The size and/or length of the passageway may be reduced, limited or controlled by a jet blocker 48 carried by the shaped charge 40.

The perforating tool 12 includes a carrier body 50 constructed of a cylindrical sleeve. In the embodiment illustrated, the carrier body 50 optionally includes a plurality of radially reduced areas depicted as scallops or recesses 52. Radially aligned with each of the recesses 52 is a respective one of a plurality of shaped charges 40, only one of which is illustrated in FIG. 2. A discharge end 56 of the shaped charge 40 is arranged adjacent the recess 52, and an initiation end 58 end of the shaped charge 40 is arranged adjacent a detonator cord 54 extending through the perforating tool 12. The detonator cord 54 may be constructed of an explosive strand, such as a Primacord®, which may be detonated to thereby detonate each of the shaped charges 40 in the perforating tool 12.

Each of the shaped charges 40 is longitudinally and radially aligned with one of the recesses 52 in carrier gun body 102 when perforating tool 12 is assembled. The shaped charges 40 may be arranged in a spiral pattern such that each of the shaped charges 40 is disposed on its own level or height and is to be individually detonated so that only one shaped charge 40 is fired at a time. It will be appreciated, however, that alternate arrangements of shaped charges 40 may be used, including cluster type designs wherein more than one shaped charge 40 is at the same level and is detonated at the same time, without departing from the principles of the present disclosure.

Figure 3:
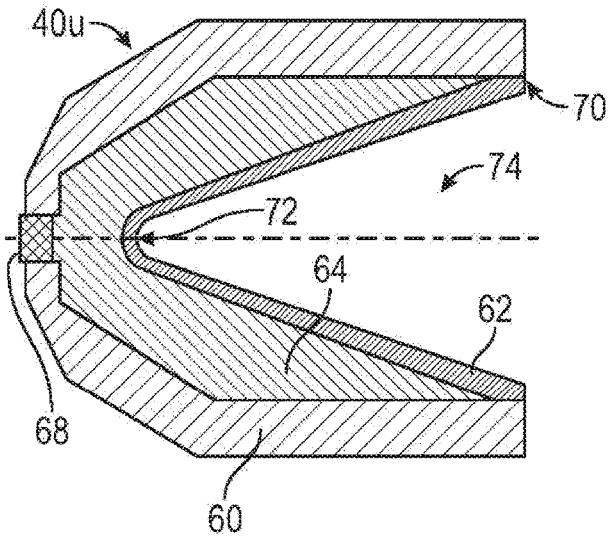
FIG. 3 is a cross sectional view of the shaped charge of FIG. 2 in an un-modified configuration for forming a perforation with unrestricted penetration, illustrating a case, explosive and a liner defining an apex.

Referring now to FIG. 3, a shaped charge 40*u* is illustrated in an un-modified configuration for forming a perforation with unrestricted penetration. The un-modified shaped charge 40*u* includes a case 60, a liner 62, and a main-load explosive material 64 disposed between the liner 62 and the case 60. A booster explosive 68 may be disposed at the initiation end 58 of the shaped charge 40*u*, and may operate to facilitate couple the main-load explosive material 64 to the detonation cord 54 (FIG. 2).

The case 60 operates to protect the inner explosive materials 64, 68 during handling and storage of the shaped charge 40*u*, and provides a mass against which the explosion can react in operation. The case 60 may be constructed of steel, e.g., or another suitable material. The liner 62 can be attached to the case 60 by a glue bead or other mechanical mechanism defined between a liner skirt 70 and the case 60. The liner 62 may be constructed from any suitable material, including metallic materials, e.g., brass, copper, steel, aluminum, zinc, lead, and tungsten (or combinations of these and other suitable materials). The liner 62 is generally parabolic or cone-shaped such that an apex 72 is defined at an innermost end of an external recess, cavity or external concavity 74 of the shaped charge 40*u* circumscribed by the liner 62. The shaped charge 40*u* may generally rely on a collapse of the liner 62 to develop a high speed jet for creating tunnels or passageways into the geologic formation "G" (FIG. 1) during a perforation event. Often, un-modified shaped charges 40*u* are provided with at least a portion of the liner 62 constructed of a dense material that is present in this high speed jet. The energy that is thus transferred to the dense material may be more effectively concentrated to promote deeper tunnels.

Figure 4:
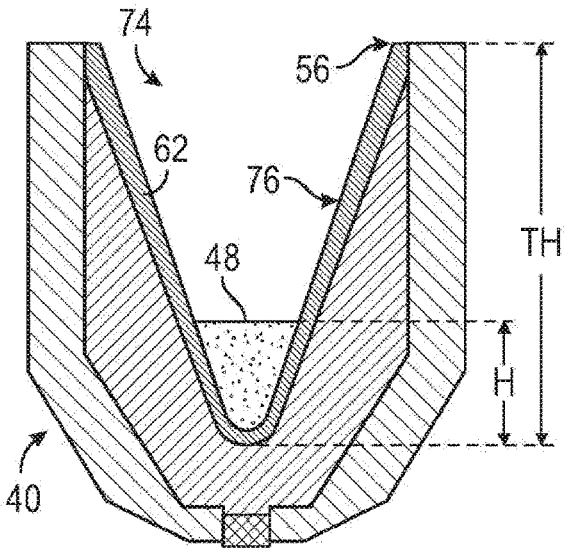
FIG. 4 is a cross sectional view of the shaped charge of FIG. 2 in a modified configuration for forming a limited penetration perforation, illustrating a jet blocker installed in the apex of the liner.

FIG. 4 is a cross sectional view of the limited penetration shaped charge 40, which may be formed from the un-modified configuration (FIG. 3) by the installation of the jet blocker 48. In some embodiments, the jet blocker 48 is a solid, plastic or metal billet that is machined to an appropriate size and shape, and then secured in the concavity 74. The jet blocker 48 may be constructed of a material that is similar to a material of the liner 62 or distinct from the material of the liner 62. In some embodiments, the jet blocker 48 may be constructed of a cast-cure type of material such as glue, epoxy, acrylic, RTV silicone or similar material, which can flowed into the apex 72 of the liner 62 to any desired height "H." As described in greater detail below, the height "H" may be predetermined to limit the force generated by the shaped charge 40 during detonation. Thus, a specific target annulus 26 (FIG. 2) may be penetrated without penetrating a casing layer or another structure surrounding the target annulus 26. In some embodiments, the height "H" may be less than about half of a total height "TH" defined by the external concavity 74.

The jet blocker 48 may form itself to the shape of the liner apex 72 without the need for machining, and may then be cured to bond with the liner 62. An adhesive bond may be established between the jet blocker 48 and the liner 62, either by virtue of the curing of the cast-cure material, or by an additional adhesive if necessary. The jet blocker 48 may thus be secured in place without the need for an additional cover, which could disrupt the operation of the shaped charge. Preferably, the jet blocker 48 may generally include lightweight materials such that the susceptibility of the shaped charge 40 to vibration damage as the perforating tool 12 (FIG. 1) is run into the wellbore 16.

The liner 62 includes a jet producing region 76 between the jet blocker 48 and the discharge end 56 of the shaped charge 40. The jet producing region 76 of the liner 62 is substantially devoid of jet blocker material. As described below (see FIG. 6C) the jet producing region 76 may collapse onto itself during detonation to produce a jet.

FIGS. 5A through 5E are schematic views in sequence illustrating a jet 80 formed by an un-modified shaped charge 40*u* for forming an unrestricted penetration perforation. Initially or immediately after detonation (FIG. 5A), the case 60 and the liner 62 are generally intact. An explosive wave advances through the main load explosive 64 from the ignition end 58 toward the discharge end 56. When the wave reaches the apex 72 of the liner 62, the liner 62 collapses radially inwardly and forms an initial jet (FIG. 5B) 82. After a time interval, e.g., 20 microseconds, has elapsed after detonation, (FIGS. 5C and 5D) the liner 62 is continuing to collapse and the case 60 begins to separate into fragments 84. After a greater time interval, e.g., 50 microseconds, the liner 62 has completely collapsed, and the complete jet 80 may extend a length "L" toward or into the geologic formation "G" (FIG. 1). The jet 80 may travel at a relatively high velocity, e.g., 20,000 ft/sec, through casing, cement and geologic layers forming a perforations and passageways therein.

Figure 5A:
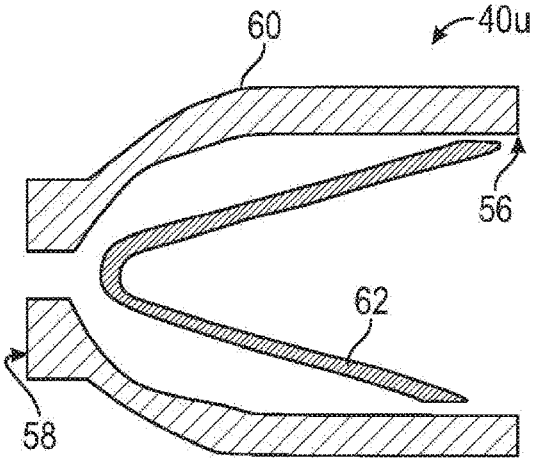
FIGS. 5A through 5E are schematic views in sequence illustrating a jet formed by an un-modified shaped charge for forming an unrestricted penetration perforation.
Figure 5B:
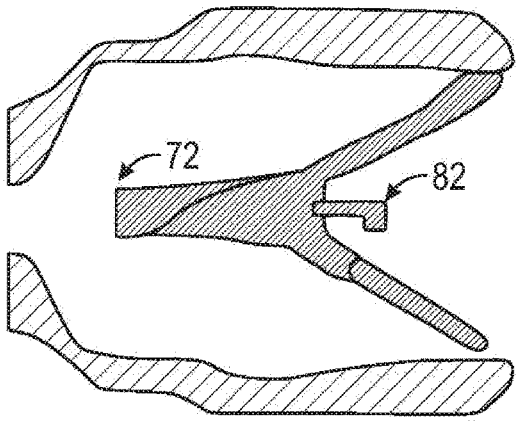
Figure 5C:
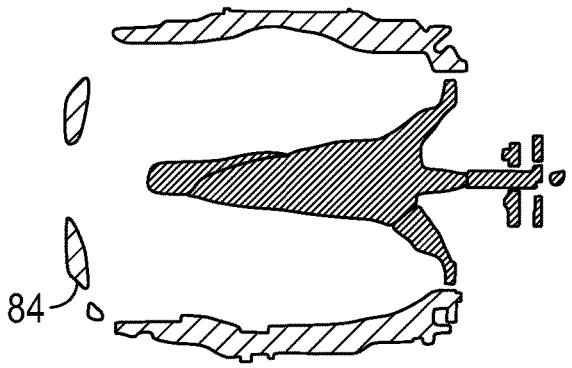
Figure 5D:
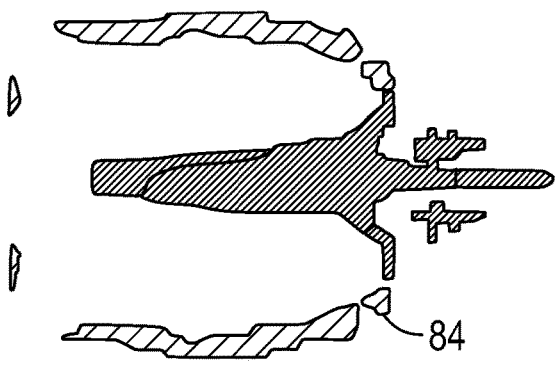
Figure 5E:
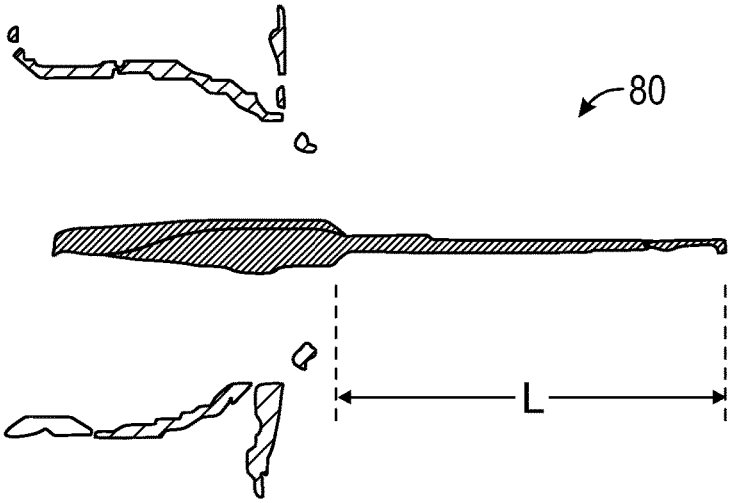
Figure 6A:
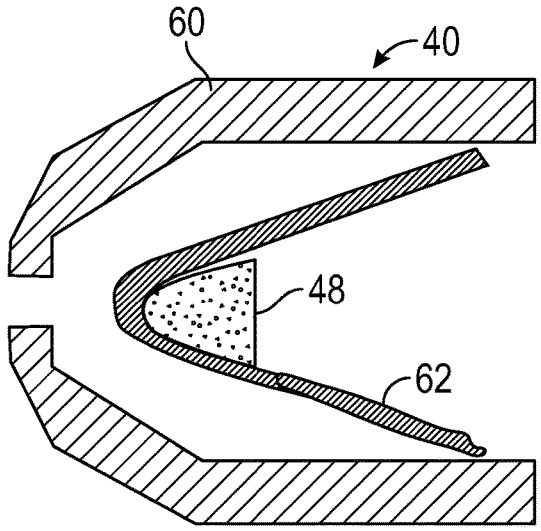
FIGS. 6A through 6E are schematic views in sequence illustrating a jet formed by a modified shaped charge for forming a limited penetration perforation.
Figure 6B:
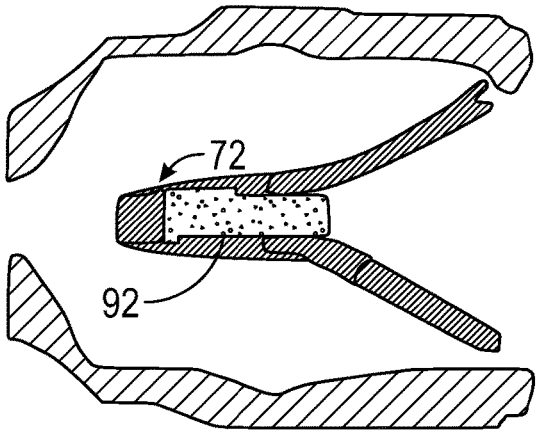
Figure 6C:
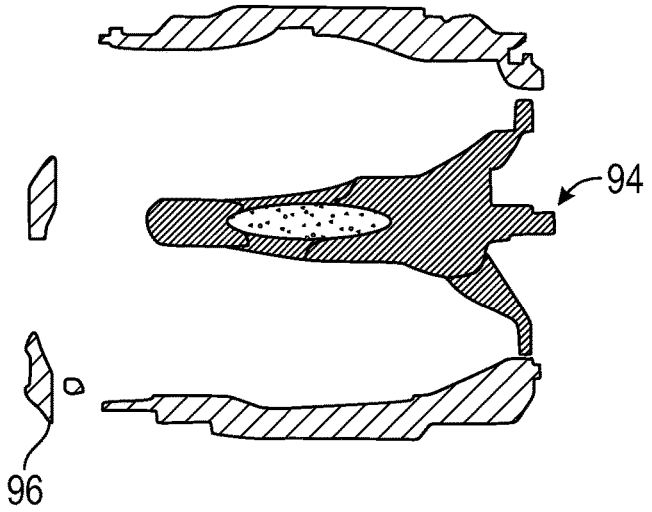
Figure 6D:
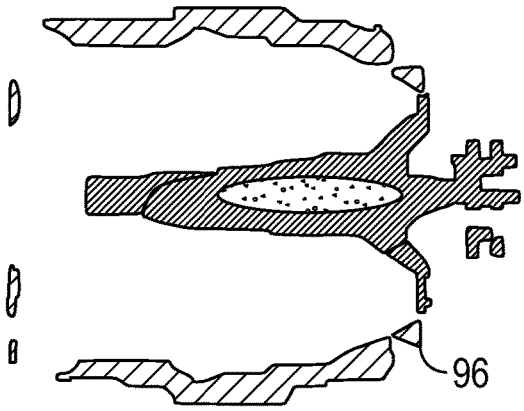
Figure 6E:
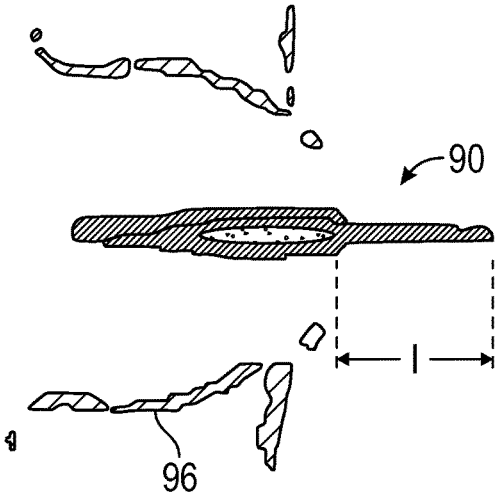

FIGS. 6A through 6E are schematic views in sequence illustrating a jet 90 formed by a modified shaped charge 40 for forming a limited penetration perforation. Initially or immediately after detonation (FIG. 6A), the case 60, the liner 62 and the jet blocker 48 are generally intact. As the explosive wave advances to the apex 72 (FIG. 6B), the liner 62 collapses and envelops the jet blocker 48 such that a relatively low density plug 92 is formed within the collapsing liner material. The jet blocker 48 prevents the formation of an initial jet 94 of liner material until a time interval, e.g., 20 microseconds, has elapsed after detonation (FIG. 6C). The jet 94 does not form until the liner material collapses onto itself between the beyond the plug 92. The liner 62 continues to collapse and the case 60 separates into fragments 96 (FIG. 6D). After a greater time interval, e.g., 50 microseconds and after the liner 62 has completely collapsed, the jet 90 may extend a reduced length "l" as compared to the length "L" of the jet 80 (FIG. 5E). The jet 90 may also travel at a relatively low velocity compared to the jet 80. Since the jet 90 is slower and shorter than the jet 80, the jet 90 produces a reduced penetration effect. For example, the jet 90 may impart a relatively low energy to the inner casing 22 (FIG. 2) such that the jet 90 penetrates only a specific predetermined number of casing layers in the wellbore 16. For example, the jet 90 may penetrate only the inner casing 22 without penetrating the outer casing 20 to form passageway 44 that extends only to the target annulus 26.

Figure 7:
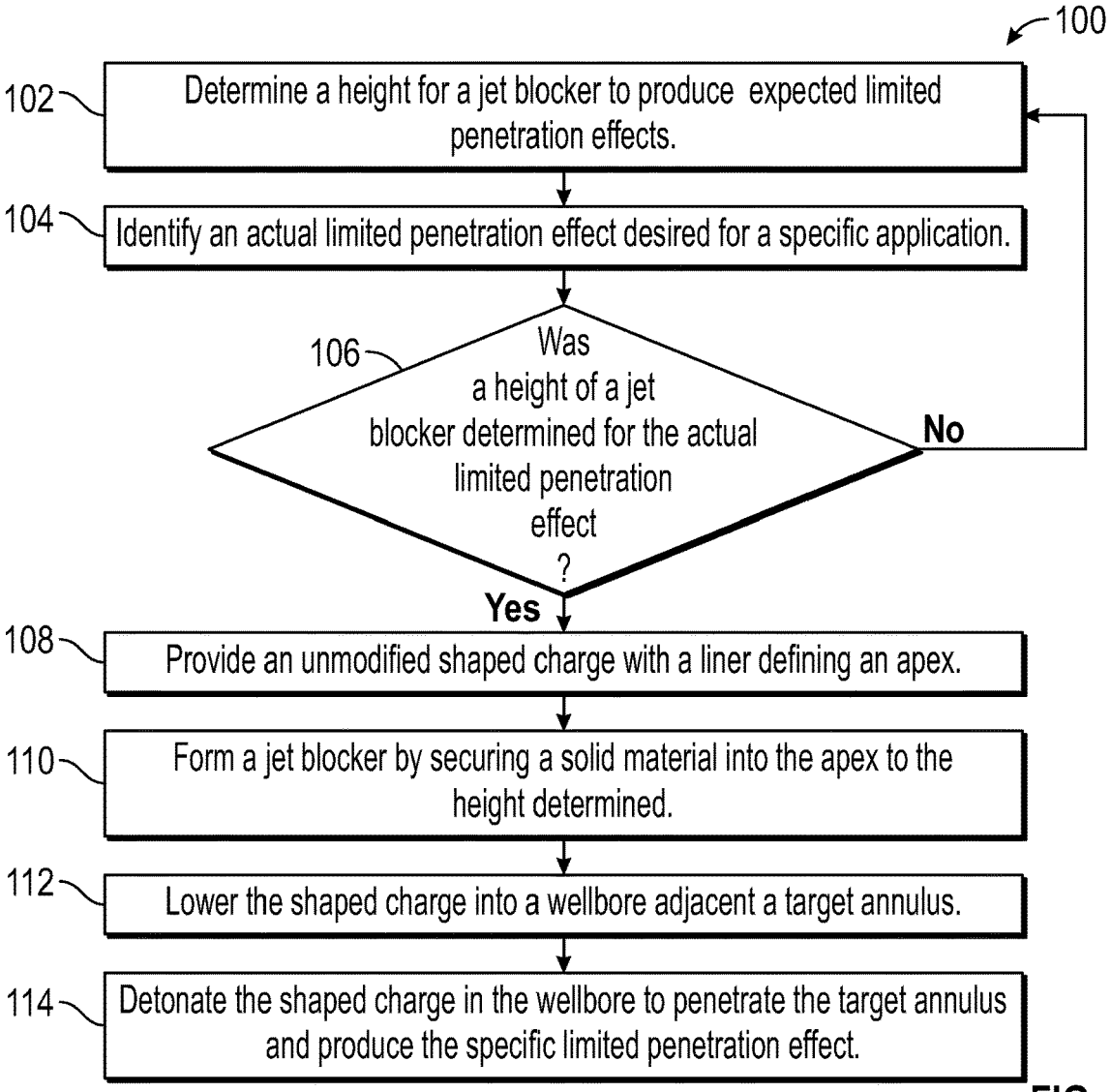
FIG. 7 is a diagrammatic view of a procedure for planning, modifying and discharging a shaped charge for forming a limited penetration shaped charge according to example embodiments of the present disclosure.

FIG. 7 is a diagrammatic view of a procedure 100 for planning, modifying and discharging a shaped charge 40 for forming a limited penetration shaped charge 40 according to example embodiments of the present disclosure. Initially at step 102, the procedure 100 begins by determining a height "H" for a jet blocker 48 that will produce expected specific limited penetration effect. The height "H" may be determined empirically. For example, various modified shaped charges 40 having various liner materials and configurations may be tested by detonating a modified shaped charge adjacent reference casing coupons to determine the penetration characteristics of the various shaped charges 40. The height "H" of the jet blocker 48 may be varied and tested, and the particular material of the jet blocker 48 may also be varied and tested. For example, different jet blocker materials having different densities, ductility and other material characteristics may be tested. Intermediate values may be interpolated and/or estimated based on the empirical testing. A data set of the limited penetration effects of various modified shaped charges 40 may thereby be assembled.

Next, at step 104, when an actual application arises requiring a limited penetration perforation, the actual required limited penetration effect is identified. For example, the exact casing scenario may be assessed, and a target annulus 26 may be identified. Next, the procedure 100 proceeds to decision 106 where it is determined whether the data set assembled in step 102 includes the limited penetration effect identified in step 104. If no jet blocker 40 was tested that would produce the required limited penetration effect, then the procedure 100 may return to step 102 where additional testing may be performed. For example, a greater height "H" of a jet blocker 48 may be tested if less force is required, and a lower height "H" may be tested if a greater force is required than test blockers 48 previously tested were determined to provide.

If a jet blocker 10 was tested that would produce the required limited penetration effect, then the procedure proceeds to step 108. An un-modified shaped charge 40*u* may be provided that includes a liner 62 defining an apex 72. The un-modified shaped charge 40*u* may be, e.g., a commercially available shaped charge with known or documented penetration characteristics.

Next, those known or documented penetration characteristics may be limited or reduced in step 110 by the formation of a jetblocker 48 in the external concavity 74 of the un-modified shaped charge 40*u*. In some embodiments, the jet blocker 48 is formed by first forming a billet from the solid material remote from the shaped charge 40, and securing the billet in the external concavity 74 to form the jet blocker 48. The billet may be formed, e.g., by machining metal or plastic blank to have the appropriate height "H," and thereafter the billet may be secured in the concavity 74 by an adhesive or by another mechanism.

Alternatively, to form the jet blocker 40, a cast-cure material may be flowed into the external concavity 74 to cover the apex 72 and up to the height "H" predetermined in step 102. The cast-cure material may be permitted to cure and bond with the liner 62 to thereby form the jet blocker 48. The jet blocker 48 may then be self-supporting in the liner 62, with no substantial redesign of the un-modified shaped charge 40*u*. The jet blocker 48 may be supported vertically in the external concavity as the cast-cure material cures.

The resulting shaped charge 40 may then be lowered into a wellbore 16 to a downhole location adjacent a target annulus (step 112). The shaped charge 40 may then be detonated in the wellbore 16 to penetrate the target annulus 26 without penetrating the outer casing 20 surrounding the target annulus 26.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a shaped charge operable for forming a limited penetration perforation in a wellbore. The shaped charge includes a case, a main load explosive material disposed within the case, a liner coupled to the case and substantially enclosing the main load explosive material within the case. The liner defines an external concavity forming an apex. The shaped charge also includes a jet blocker formed from a solid material extending to a predetermined height above the apex within the external concavity.

In one or more example embodiments, the jet blocker may be constructed of a curable material that is flowed into the external concavity and cured within the external concavity. The jet blocker may include at least one of the group of materials consisting of glue, epoxy, acrylic, RTV and silicone. In some embodiments, the liner comprises a metallic material forming the external concavity in a cone shape.

In some embodiments, a bond is established between the jet blocker and the liner material by curing the curable material. A jet forming portion of the liner may be substantially devoid of the solid material forming the jet blocker. In some embodiments, the predetermined height is less than about half of a total height of the external concavity. In some embodiments, the shaped charge further includes a booster explosive disposed at an initiation end of the shaped charge.

In another aspect, the disclosure is directed to a method of modifying a shaped charge to produce a limited penetration perforation in a wellbore. The method includes (a) providing a shaped charge having a case, main load explosive and a liner defining an external concavity, and (b) forming a jet blocker by securing a solid material into the external concavity to fill a predetermined height of the external concavity such that a jet forming portion of the liner is substantially devoid of the solid material forming the jet blocker.

In some embodiments, the method further includes curing a cast-cure material within the external concavity from the solid jet blocker material. The method may also include bonding the cast-cure material with the liner by curing the cast-cure material so as to form a self-supporting jet blocker in the external cavity. In some embodiments, the method further includes forming a billet from the solid material remote from the shaped charge, and securing the billet in the external concavity to form the jet blocker.

In one or more example embodiments, the method further includes determining the height by detonating modified shaped charges adjacent reference casing coupons and empirically determining the penetration characteristics of various modified shaped charges.

Empirically determining the penetration characteristics of various modified shaped charges may include detonating shaped charges with jet blockers having various heights, densities and ductilities.

The method may further include lowering the shaped charge into a wellbore and detonating the shaped charge adjacent a target annulus. In some embodiments, detonating the shaped charge adjacent the target annulus includes penetrating the target annulus without penetrating an outer member surrounding the target annulus. In some example embodiments, detonating the shaped charge includes collapsing the liner around the jet blocker to form a plug, and further collapsing the liner to form a limited-length and limited speed jet of the liner material. In another aspect, the disclosure is directed to a perforating tool system for forming a limited penetration perforation in a wellbore. The perforating tool includes a carrier body constructed of a cylindrical sleeve, a plurality of shaped charges disposed within the carrier body, each of the shaped charges having a case, main load explosive and a liner defining an external concavity, and a jet blocker formed in the external concavity of each shaped charge, the jet blocker formed from a solid material filled to a predetermined height in the external concavity such that a jet forming portion of the liner is substantially devoid of jet blocker material.

In some embodiments, the perforating tool system further includes a detonator cord extending through the carrier body and coupled to each of the shaped charges. The perforating tool system may also include a conveyance coupled to the carrier body, the conveyance operable to lower the carrier body into a wellbore.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A shaped charge operable for forming a limited penetration perforation in a wellbore, the shaped charge comprising:

a case;

a main load explosive material disposed within the case;

a liner coupled to the case and substantially enclosing the main load explosive material within the case, the liner defining an external recess forming an apex; and a non-explosive jet blocker formed from a solid material extending to a predetermined height above the apex within the external recess and entirely filling the external recess up to the predetermined height such that an entire portion of the liner below the predetermined height is in contact with the solid material and a jet forming portion of the liner above the predetermined height does not contact the solid material.

2. The shaped charge according to claim 1, wherein the jet blocker is constructed of a curable non-explosive material that is flowed into the external recess and cured within the external recess.

3. The shaped charge according to claim 2, wherein the jet blocker comprises at least one of the group of non-explosive materials consisting of glue, epoxy, acrylic, root-temperature-vulcanizing (RTV) silicone and silicone.

4. The shaped charge according to claim 3, wherein the liner comprises a metallic material forming the external recess in a cone shape.

5. The shaped charge according to claim 2, wherein a bond is established between the jett blocker and the liner material by curing the curable material.

6. The shaped charge according to claim 1, wherein a portion of the external recess circumscribed by the jet forming portion of the liner is substantially devoid of the solid material forming the jet blocker.

7. The shaped charge according to claim 1, wherein the predetermined height is less than about half of a total height of the external recess.

8. The shaped charge according to claim 1, further comprising a booster explosive disposed at an initiation end of the shaped charge.

9. A method of modifying a shaped charge to produce a limited penetration perforation in a wellbore, the method comprising:

providing a shaped charge having a case, main load explosive and a liner circumscribing an external recess of the shaped charge; and forming a non-explosive jet blocker by securing a solid material into the external recess to fill a predetermined height of the external recess such that an entire portion of the recess below the predetermined height is filled with the solid material and a portion of the recess above the predetermined height is substantially devoid of the solid material forming the jet blocker.

10. The method according to claim 9, further comprising, curing a cast-cure material within the external recess form the solid jet blocker material.

11. The method according to claim 10, further comprising bonding the cast-cure material with the liner by curing the cast-cure material so as to form a self-supporting jet blocker in the external recess.

12. The method according to claim 9, further comprising forming a billet from the solid material remote from the shaped charge, and securing the billet in the external recess to form the jet blocker.

13. The method according to claim 9, further comprising determining the height by detonating modified shaped charges adjacent reference casing coupons and empirically determining penetration characteristics of various modified shaped charges.

14. The method according to claim 13, wherein empirically determining the penetration characteristics of various modified shaped charges includes detonating shaped charges with jet blockers having various heights, densities and ductilities.

15. The method of claim 9, further comprising lowering the shaped charge into a wellbore and detonating the shaped charge adjacent a target annulus.

16. The method according to claim 15, wherein detonating the shaped charge adjacent the target annulus comprises penetrating the target annulus without penetrating an outer member surrounding the target annulus.

17. The method according to claim 15, wherein detonating the shaped charge comprises collapsing the liner around the jet blocker to form a plug, and further collapsing the liner to form a limited-length and limited speed jet of the liner material.

18. A perforating tool system for forming a limited penetration perforation in a wellbore, the perforating tool comprising:

a carrier body constructed of a cylindrical sleeve;

a plurality of shaped charges disposed within the carrier body, each of the shaped charges having a case, main load explosive and a liner defining an external recess; and a non-explosive jet blocker formed in the external recess of each shaped charge, the jet blocker formed from a solid material filled to a predetermined height in the external recess such that an entire portion of the recess below the predetermined height is filled with the solid material and a portion of the recess above the predetermined height is substantially devoid of jet blocker material.

19. The perforating tool system according to claim 18, further comprising a detonator cord extending through the carrier body and coupled to each of the shaped charges.

20. The perforating tool system according to claim 18, further comprising a conveyance coupled to the carrier body, the conveyance operable to lower the carrier body into a wellbore.

* * * * *